United States Patent [19]

Louzos et al.

[11] 4,167,458

[45] Sep. 11, 1979

[54] LITHIUM ION-CONTAINING ORGANIC ELECTROLYTE

[75] Inventors: Demetrios V. Louzos, Rocky River; Ralph J. Brodd, Parma Heights, both of Ohio

[73] Assignee: Union Carbide Corporation, New York, N.Y.

[21] Appl. No.: 890,971

[22] Filed: Mar. 28, 1978

[51] Int. Cl.[2] ..... C25D 3/54; C25C 1/22

[52] U.S. Cl. ..... 204/14 N; 204/59 AM

[58] Field of Search ..... 204/14 R, 14 N, 59 AM, 204/69; 429/197

[56] References Cited

U.S. PATENT DOCUMENTS

| | | | |
|---|---|---|---|
| 3,544,385 | 12/1970 | Newman | 429/197 |
| 3,580,828 | 5/1971 | Reddy | 204/14 N |
| 3,907,597 | 9/1975 | Mellors | 429/197 |
| 3,953,302 | 4/1976 | Rao et al. | 204/14 N |

*Primary Examiner*—T. M. Tufariello

*Attorney, Agent or Firm*—Cornelius F. O'Brien

[57] ABSTRACT

A lithium ion-containing solvent-electrolyte suitable for the electrodeposition of lithium in electrochemical cells, said electrolyte comprising lithium fluoroborate dissolved in a mixture of methylene chloride and sulfolane and/or the alkyl-substituted derivatives thereof.

10 Claims, No Drawings

LITHIUM ION-CONTAINING ORGANIC ELECTROLYTE

FIELD OF THE INVENTION

The invention relates to a solvent-electrolyte and a process for the electrodeposition of lithium in a nonaqueous electrolyte comprising lithium fluoroborate dissolved in a mixture of methylene chloride and sulfolane and/or the alkyl-substituted derivatives thereof.

BACKGROUND OF THE INVENTION

Considerable efforts in the prior art have been devoted to the electrodeposition of lithium to form lithium sheets, strips or the like. One of the major requirements in the electrodeposition of lithium is to obtain a deposition of nondendritic, adherent, flat lithium deposits. Many electrolytes, particularly many known organic electrolytes, tend to produce only dendritic or mossy lithium on plating, sometimes accompanied by gas evolution. Deposits of these types tend to spall off the lithium electrode substrate. U.S. Pat. No. 3,580,828 discloses that the electrodeposition of lithium from an electrolyte comprising a lithium salt in a nonaqueous organic liquid solvent, such as propylene carbonate, will produce a dense, coherent deposit of lithium on a substrate if carried out under precise concentration and current density limits.

It is an object of the present invention to provide an electrolyte comprising lithium fluoroborate dissolved in a mixture of methylene chloride and sulfolane and/or the alkyl-substituted derivatives thereof.

It is another object of the present invention to provide a process for electrodeposition of a dense, cohesive deposit of lithium from a nonaqueous electrolyte comprising lithium fluoroborate dissolved in a mixture of methylene chloride and sulfolane and/or the alkyl-substituted derivatives thereof.

SUMMARY OF THE INVENTION

The invention broadly relates to a process for electrodeposition of lithium from a nonaqueous electrolyte wherein said electroplating is carried out with an electrolyte of lithium fluoroborate ($LiBF_4$) substantially completely dissolved in a solvent mixture of methylene chloride and at least one additional solvent selected from the group consisting of sulfolane and the alkyl-substituted derivatives thereof, and wherein said lithium fluoroborate is present in a concentration of about 3 percent by weight based on the weight of the solvent mixture up to saturation of the lithium fluoroborate in the electrolyte solvent mixture. Preferably, the sulfolane and/or the alkyl-substituted derivatives thereof should consist of between about 20 and about 80 volume percent of the electrolyte solvent mixture with the remainder being methylene chloride and most preferably between about 50 and about 60 volume percent of the electrolyte solvent mixture.

In the process of this invention, lithium can be electrodeposited on a substrate under anydrous conditions using a current density up to about 10 milliamperes per square centimeter (ma/cm$^2$). Preferably, a current density of between about 1 ma/cm$^2$ and about 5 ma/cm$^2$ would be sufficient to yield a cohesive, nondendritic, grain-like deposit of lithium on a substrate using the lithium ion-containing electrolyte of this invention with a current density of about 3 ma/cm$^2$ being most preferred.

The invention also relates to a solvent-electrolyte system for the electrodeposition of lithium comprising an ionizable solute of lithium fluoroborate substantially completely dissolved in a solvent mixture of methylene chloride and at least one additional solvent selected from the group consisting of sulfolane and the and the alkyl-substituted derivatives thereof, said lithium fluoroborate being present in a concentration of about 3 percent by weight based on the weight of the solvent mixture up to saturation of the lithium fluoroborate in the electrolyte solvent mixture. Preferably, the sulfolane and/or the alkyl-substituted derivatives thereof should consist of between about 20 and about 80 volume percent of the electrolyte solvent mixture with the remainder being methylene chloride and most preferably between about 50 and about 60 volume percent of the electrolyte solvent mixture.

Sulfolane for use in this invention is a 1, 1-dioxotetrahydrothiophene (sometimes called tetramethylene sulfone) and is a saturated heterocyclic compound of the structure:

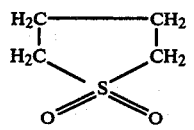

Some of the physical properties of sulfolane are shown in Table 1:

TABLE 1

| | |
|---|---|
| Melting Point (°C.) | 28 |
| Boiling Point (°C.) | 283 |
| Sp. Cond., 25° C.) (ohm$^{-1}$ cm$^{-1}$) | $2 \times 10^{-8}$ |
| Dielectric Constant, 25° C. | 44 |
| Density, 30° C. (g/cm$^3$) | 1.2615 |
| Viscosity, 30° C. (centipoise) | 9.87 |
| Freezing Point Depression Constant | 66.2 |

The 3-methyl sulfolane, which is a liquid alkyl-substituted derivative of the above structure and is also suitable for use in this invention, has the following structure:

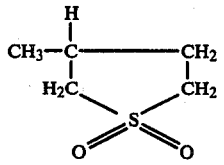

In using the electrolyte of this invention for electrodepositing of lithium, then a concentration of lithium fluoroborate less than about 3 percent by weight based on the weight of the electrolyte solvent mixture would generally result in the deposition of dendritic deposits of lithium.

When the amount of the lithium fluoroborate present exceeds the saturation level, then solid particles of the lithium salt could be dispersed throughout the electrolyte solvent mixture and could adhere to the surface of the lithium being deposited thereby forming a nodulose deposit composed of lithium and lithium salt. It is well known in the electrodepositing art that the electrolyte solvent mixture should be substantially free of any solid particles so as to insure the obtaining of a cohesive deposit of the metal being deposited.

It has been found that lithium fluoroborate will not dissolve in methylene chloride and thus methylene chloride cannot be used as the sole solvent of the electrolyte. It has also been found that although lithium fluoroborate is soluble in sulfolane, the use of sulfolane as the sole solvent for the lithium salt will produce an electrolyte which when used in an electrodeposition process will result in the forming of some dendritic deposits of lithium on the substrate edges. Thus in accordance with the present invention, when the electrolyte solvent mixture is preferably composed of from about 20 to about 80 volume percent of sulfolane and/or the alkyl-substituted derivatives thereof, with the remainder being methylene chloride and with lithium fluoroborate substantially dissolved in said solvent mixture, then using the electrolyte solvent mixture so formed in an electrodeposition process, a coherent layer of nondendritic lithium can be deposited on a substrate. When the concentration of the sulfolane and/or the alkyl-substituted derivatives thereof are below 20 volume percent of the electrolyte solvent mixture, then using the electrolyte in an electrodeposition process will result in a slightly dendritic deposit of lithium. When the sulfolane and/or the alkyl-substituted derivatives thereof are present in a concentration of above 80 volume percent, then the electrolyte when used in an electrodeposition process will result in a slightly dendritic deposit of lithium. Thus it has been found that in order to obtain a dense, cohesive, nondendritic deposit of lithium, the electrolyte should be composed of lithium fluoroborate substantially dissolved in a mixture of methylene chloride and sulfolane and/or the alkyl-substituted derivatives thereof in which the concentration of the sulfolane and/or the alkyl-substituted derivatives thereof are preferably present between about 20 and about 80 volume percent of the electrolyte solvent mixture.

EXAMPLE I

To study the effects of varying the volume ratio of sulfolane to methylene chloride in saturated $LiBF_4$ electrolytes upon the morphology of lithium electrodeposits, glass cells were constructed using two spaced-apart, essentially parallel lithium electrodes in about 15 ml of an electrolyte comprising lithium fluoroborate dissolved in sulfolane, methylene chloride or various mixtures thereof.

Each of the lithium electrodes was made by pressing lithium into an expanded nickel screen such that two square centimeters of lithium area were available on each side of a one-centimeter by 2-centimeter electrode. The current density was calculated by using only the area (2 $cm^2$) of one side of each lithium electrode which was essentially parallel to and spaced apart approximately 1.25 centimeters from the second lithium electrode. In a dry argon atmosphere at room temperature, the cells so constructed were used for electrodepositing lithium on one of the electrodes. The data so obtained are shown in Table 2.

As evident from the data shown in Table 2, an electrolyte comprising lithium fluoroborate dissolved in a mixture of from 40% by volume to 80% by volume of sulfolane with the remainder methylene chloride can be employed to produce a dense, cohesive deposit of lithium on a lithium substrate.

Several cells were constructed as described in Example I employing the same type lithium electrodes and an elctrolyte of various concentrations of lithium fluoroborate dissolved in 60% by volume sulfolane and 40% by volume methylene chloride. Using the same test procedure as described in Example I, the cells were used for electrodepositing lithium on one of the electrodes (cathode). The data so obtained are shown in Table 3.

As is apparent from the data shown in Table 3, varying the lithium fluoroborate concentrations in the electrolyte over the range from 3% to saturation did not appear to have any effect upon the morphology of the lithium electrodeposit obtained from the test. In each case, a dense, cohesive deposit of lithium was formed on one of the lithium electrodes.

TABLE 2

| Volume Percent* | | Specific Conductance** | Lithium Electrode Appearance |
|---|---|---|---|
| Sulfolane | Methylene Chloride | $ohm^{-1}\ cm^{-1}$ | After 3 Hrs Electrolysis at 3 $mA/cm^2$ |
| 100% | 0 | $1.39 \times 10^{-3}$ | Dendritic growth at all edges |
| 80% | 20% | $1.85 \times 10^{-3}$ | Grains, flat, and evenly dispersed across electrode face |
| 70% | 30% | $2.17 \times 10^{-3}$ | Grains, flat, and evenly dispersed across electrode face |
| 60% | 40% | $2.22 \times 10^{-3}$ | Grains, flat, and evenly dispersed across electrode face; perhaps a little smoother than 50-50% |
| 50% | 50% | $2.08 \times 10^{-3}$ | Grains, flat, and evenly dispersed across electrode face |
| 40% | 60% | $1.64 \times 10^{-3}$ | Same as above but a few crystals visible at bottom corners |
| 0 | 100% | $LiBF_4$ is insoluble in methylene chloride alone | |

*-All solutions are saturated with $LiBF_4$ (9%).
**-Four determinations made in each case.

TABLE 3

| $LiBF_4$ % by weight | Specific Conductance* $ohm^{-1}cm^{-1}$ | Lithium Electrode Appearance After 3 Hrs Electrode at 3 $mA/cm^2$ |
|---|---|---|
| Saturated (~9%) | $2.22 \times 10^{-3}$ | Grains, flat, and evenly dispersed across electrode face |
| 7% | $2.22 \times 10^{-3}$ | Grains, flat, and evenly dispersed across electrode face |
| 5% | $2.08 \times 10^{-3}$ | Grains, flat, and evenly dispersed across electrode face |
| 3% | $1.81 \times 10^{-3}$ | Grains, flat, and evenly dispersed across electrode face |

*Four determinations made in each case.

EXAMPLE II

To compare the effect of various types of lithium ion-containing solutes in an electrolyte solvent mixture of sulfolane and methylene chloride, several cells were constructed as described in Example I using the same type lithium electrodes. The electrodes for each cell consisted of equal volumes of sulfolane and methylene chloride in which was dissolved a known lithium-ion containing solute as specified in Table 4.

Using the same testing procedure as described in conjunction with Example I, the cells were used to electrodeposit lithium onto one of the lithium electrodes. The data so obtained from the tests are shown in Table 4.

As is apparent from the data shown in Table 4, the cell with the $LiBF_4$-containing electrolyte produced an even deposit of lithium on one of the lithium electrodes while the cells with the $LiAlCl_4$-, $LiAsF_6$-, $LiPF_6$-, $LiCF_3SO_3$- and $LiClO_4$- containing electrolytes produced either non-coherent lithium deposits which fell off the lithium electrode ($LiAlCl_4$, $LiPF_6$), a light gray, partially dendritic lithium deposit ($LiAsF_6$, $LiClO_4$) or a deposit with some roughness ($LiCF_3SO_3$).

EXAMPLE III

To compare the effect of replacing methylene chloride with 1,3-dioxolane in the electrolyte employed in Example II, several cells were constructed as described in Example II using the same type lithium electrodes as described in Example I. The electrolyte for each cell consisted of equal volumes of sulfolane and 1,3-dioxolane in which was dissolved a known lithium ion-containing solute as specified in Table 5.

TABLE 4

| Solute (wt. %) | Appearance of Lithium Electrode After 30 Minutes | After 3 Hours |
|---|---|---|
| $LiBF_4$* | Light, even deposit. | Best light, even deposit. Electrolyte has good throwing power as evidenced by even some deposition on back side of cathode. |
| 10% $LiAlCl_4$ | Dark deposit with dendritic growth. | Dark deposit largely fallen off as a fine powder. |
| 10% $LiAsF_6$ | Light gray deposit. | Light gray partially dendritic deposit. |
| 10% $LiPF_6$ | Black deposit and gas evolution. | Black deposit mostly fallen off substrate. |
| $LiCF_3SO_3$* | Light flat deposit | Light reasonably flat deposit with some rough but non-dendritic spots. |
| 10% $LiClO_4$ | Light deposit | Light reasonably flat but somewhat dendritic deposits. |

*= Saturation

Using the same testing procedure as described in conjunction with Example I, the cells were used to electro-deposit lithium onto one of the lithium electrodes. The data so obtained from the test are shown in Table 5.

TABLE 5

| Solute (wt. %) | Appearance of Electrode after 3 Hrs. at 3 mA/cm$^2$ |
|---|---|
| 10% $LiBF_4$ | Light gray deposit; dendritic; turns white on standing. |
| 10% $LiAlCl_4$ | Dark gray, almost black deposit; dendritic. |
| 10% $LiAsF_6$ | Light gray deposit; dendritic |
| 10% $LiPF_6$ | Was not electrolyzed due to formation of gel. |

As shown in Table 5, the cells employing equal volumes of sulfolane and 1,3-dioxolane in which was dissolved $LiBF_4$, $LiAlCl_4$ or $LiAsF_6$ produced dendritic deposits of lithium while the cell employing equal volumes of sulfolane and 1,3-dioxolane in which was dissolved $LiPF_6$ was not electrolysed since the elecrolyte formed a gel. A comparison of the data shown in Tables 4 and 5 clearly shows the using the electrolyte of this invention, a dense, coherent deposit of lithium can be produced on a lithium substrate at room temperature.

It is to be understood that other modifications and changes to the preferred embodiments of the invention herein shown and described can also be made without departing from the spirit and scope of the invention.

What is claimed is:

1. A solvent-electrolyte for use in a lithium electrodeposition process comprising an ionizable solute of lithium fluoroborate dissolved in a solvent mixture of methylene chloride and at least one additional solvent selected from the group consisting of sulfolane and the alkyl-substituted derivatives thereof.

2. The solvent-electrolyte of claim 1 wherein said lithium fluoroborate is present in a concentration of about 3 percent by weight based on the weight of the solvent mixture up to saturation of the lithium fluoroborate in the solvent mixture.

3. The solvent-electrolyte of claim 1 wherein the at least one additional solvent selected from the group consisting of sulfolane and the alkyl-substituted derivatives thereof is between about 20 and about 80 volume percent of the electrolyte solvent mixture.

4. The solvent-electrolyte of claim 2 wherein the at least one additional solvent selected from the group consisting of sulfolane and the alkyl-substituted derivative thereof is betwen about 20 and about 80 volume percent of electrolyte solvent mixture.

5. The solvent-electrolyte of claim 4 wherein the at least one additional solvent selected from the group consisting of sulfolane and the alkyl-substituted derivatives thereof is between about 50 and about 60 volume percent of the electrolyte solvent mixture.

6. A process for electrodeposition of lithium from a nonaqueous electrolyte wherein said electrodeposition is carried out with an electrolyte of lithium fluoroborate dissolved in a solvent mixture of methylene chloride and at least one additional solvent selected from the group consisting of sulfolane and the alkyl-substituted derivatives thereof.

7. The process of claim 6 wherein said lithium fluoroborate is present in a concentration of about 3 percent by weight based on the weight of the solvent mixture up to saturation of the lithium fluoroborate in the solvent mixture.

8. The process of claim 6 wherein the at least one additional solvent selected from the group consisting of sulfolane and the alkyl-substituted derivatives thereof is between about 20 and about 80 volume percent of the electrolyte solvent mixture.

9. The process of claim 7 wherein the at least one additional solvent selected from the group consisting of sulfolane and the alkyl-substituted derivatives thereof is between about 20 and about 80 volume percent of the electrolyte solvent mixture.

10. The process of claim 9 wherein the at least one additional solvent selected from the group consisting of sulfolane and the alkyl-substituted derivatives thereof is between about 50 and about 60 volume percent of the electrolyte solvent mixture.

* * * * *